United States Patent [19]

Sangiorgi

[11] Patent Number: 4,505,366

[45] Date of Patent: Mar. 19, 1985

[54] SEWING MACHINE MOTOR UNIT

[75] Inventor: Mario Sangiorgi, Vigevano, Italy

[73] Assignee: Mazzini Motori S.r.l., Vigevano, Italy

[21] Appl. No.: 420,231

[22] Filed: Sep. 20, 1982

[30] Foreign Application Priority Data

Nov. 20, 1981 [IT] Italy ..... 53826/81[U]

[51] Int. Cl.[3] ..... B60K 41/24

[52] U.S. Cl. ..... 192/18 B; 188/161

[58] Field of Search ..... 192/18 B, 84 AA, 84 AB, 192/18 R; 188/161, 162, 163

[56] References Cited

U.S. PATENT DOCUMENTS

| | | | |
|---|---|---|---|
| 2,693,261 | 11/1954 | Winther | 192/84 A |
| 2,912,963 | 11/1959 | Dufresne | 192/84 A |
| 3,777,864 | 12/1973 | Marti | 192/18 B |
| 3,945,476 | 3/1976 | de Jong | 192/18 B |
| 4,222,471 | 9/1980 | Hsu | 192/18 B |
| 4,429,773 | 2/1984 | Dohi et al. | 192/18 B |

FOREIGN PATENT DOCUMENTS 2105959 2/1971 Fed. Rep. of Germany .

*Primary Examiner*—George H. Krizmanich

*Attorney, Agent, or Firm*—Fleit, Jacobson, Cohn & Price

[57] ABSTRACT

A motor positioner unit for sewing machines including an electromagnetically operated brake-clutch unit comprises a fixed structure of non-ferromagnetic material and clutch and brake windings (28, 35) mounted within an annular cavity (30, 36) of a ferromagnetic insert (31, 37) carried by the fixed structure.

5 Claims, 4 Drawing Figures

SEWING MACHINE MOTOR UNIT

The present invention relates to motor positioner units for sewing machines.

In particular, the invention concerns a motor positioner unit comprising:

a motor;

a flywheel of ferromagnetic material which is connected to the drive shaft and incorporates a ring of non-ferromagnetic material;

an output shaft, and an electromagnetically operated brake-clutch unit for controlling the connection between the drive shaft and the output shaft, the brake-clutch unit including:

a clutch disc and a brake disc both of ferromagnetic material, which are slidable axially on the output shaft and connected for rotation therewith, the clutch disc and the brake disc facing respectively the flywheel and a fixed stop ring of non-ferromagnetic material forming part of the fixed structure of the motor;

a clutch winding and a brake winding carried by the fixed structure of the motor, the flywheel being interposed between the clutch winding and the clutch disc, and the fixed stop ring being interposed between the brake winding and the brake disc, and two annular friction linings for the frictional connection of the clutch disc and the brake disc with the flywheel and the fixed stop ring.

A motor unit of the type specified above is described and illustrated in German patent application DOS No. 21 05 959. In this known solution, the clutch winding and the brake winding are each mounted within an annular cavity formed in the fixed structure of the motor which is made of ferromagnetic material. As a result, when one of the two windings is energised, the magnetic flux generated thereby may leak into the fixed structure of the motor. Because of this leakage, the attractive forces necessary to effect the transmission of high torque and the rapid movement of the brake and clutch discs are achieved by using relatively high electrical power. A further disadvantage resulting from the leakage of the magnetic flux lies in the fact that the air gap between the clutch disc and the flywheel, and between the brake disc and the fixed stop ring, is relatively small and requires an accurate setting in the region of 0.15–0.20 mm. This makes the assembling and maintenance of the unit particularly complicated and laborious. Another disadvantage, connected with the fact that the attractive force developed for a particular power input is relatively low, lies in the fact that the annular friction linings must have a working part which is relatively thin, about 0.2 mm, necessitating the frequent replacement of the linings and adjustment of the air gaps. Finally, in this known solution, the two annular friction linings are carried by the brake and clutch discs, resulting in relatively rapid wear of the non-ferromagnetic material (aluminum) constituting the ring incorporated in the flywheel and the fixed stop ring.

The object of the present invention is to provide a motor positioner unit of the aforesaid type, which is free from the disadvantages mentioned above and, in particular, has a simple light structure which is easy to maintain.

The main characteristic of the motor positioner unit according to the present invention lies in the fact that the fixed structure of the unit is of non-ferromagnetic material, and the clutch and brake windings are each mounted within an annular cavity of a ferromagnetic insert carried by the fixed structure of the unit.

By virtue of this characteristic, when one of the two windings is energised, the magnetic flux generated thereby does not leak into the fixed structure of the motor positioner unit.

This allows considerable attractive forces to be developed with a smaller electrical power input, allowing high torques to be transmitted and the brake and clutch discs to be moved rapidly, in the order of thousandths of a second.

The fact that high attractive forces are developed also allows the approximate setting of the air gap, even to more than a millimeter, which makes the assembly and maintenance easy and quick and avoids the need for skilled workmen.

Another advantage of the motor positioner unit according to the present invention lies in the fact that the angular friction linings may have a relatively thick working part of the order of 1.2–1.5 mm. This makes the useful life of these linings six or seven times longer than the known solutions having a working part about 0.2 mm thick.

A further characteristic of the motor positioning unit according to the present invention lies in the fact that the two annular friction linings are fixed to the non-ferromagnetic ring incorporated in the flywheel and to the fixed stop ring, respectively. Thus, the friction linings come into sliding contact with the ferromagnetic material (steel) constituting the brake and clutch discs. The wear of this material will obviously be less than that which occurs in the known solutions in which the non-ferromagnetic material (aluminium) forming these parts comes into sliding contact with the friction linings.

Another characteristic of the motor positioner unit according to the invention lies in the fact that the drive shaft and the output shaft are biassed away from each other by resilient means, and in that a setting ring is associated with each of these shafts for pushing the respective shaft towards the other shaft against the action of the resilient means.

This allows the clearances between the brake and clutch discs and their friction linings to be adjusted particularly simply and quickly.

The motor positioner unit according to the present invention is further characterised in that the drive shaft is provided with a fan for drawing cooling air into the casing of the motor positioner unit, and in that the casing has passages for conveying at least part of this cooling air into the zone between the clutch disc and the brake disc and between these discs and their friction linings.

This further improves the characteristics of the brake-clutch unit, contributing to a reduction in the wear of the friction linings and consequently rendering their replacement less frequent.

Further characteristics and advantages of the present invention will emerge from the description which follows with reference to the appended drawings, provided purely by way of non-limiting example, in which.

Figure 1:
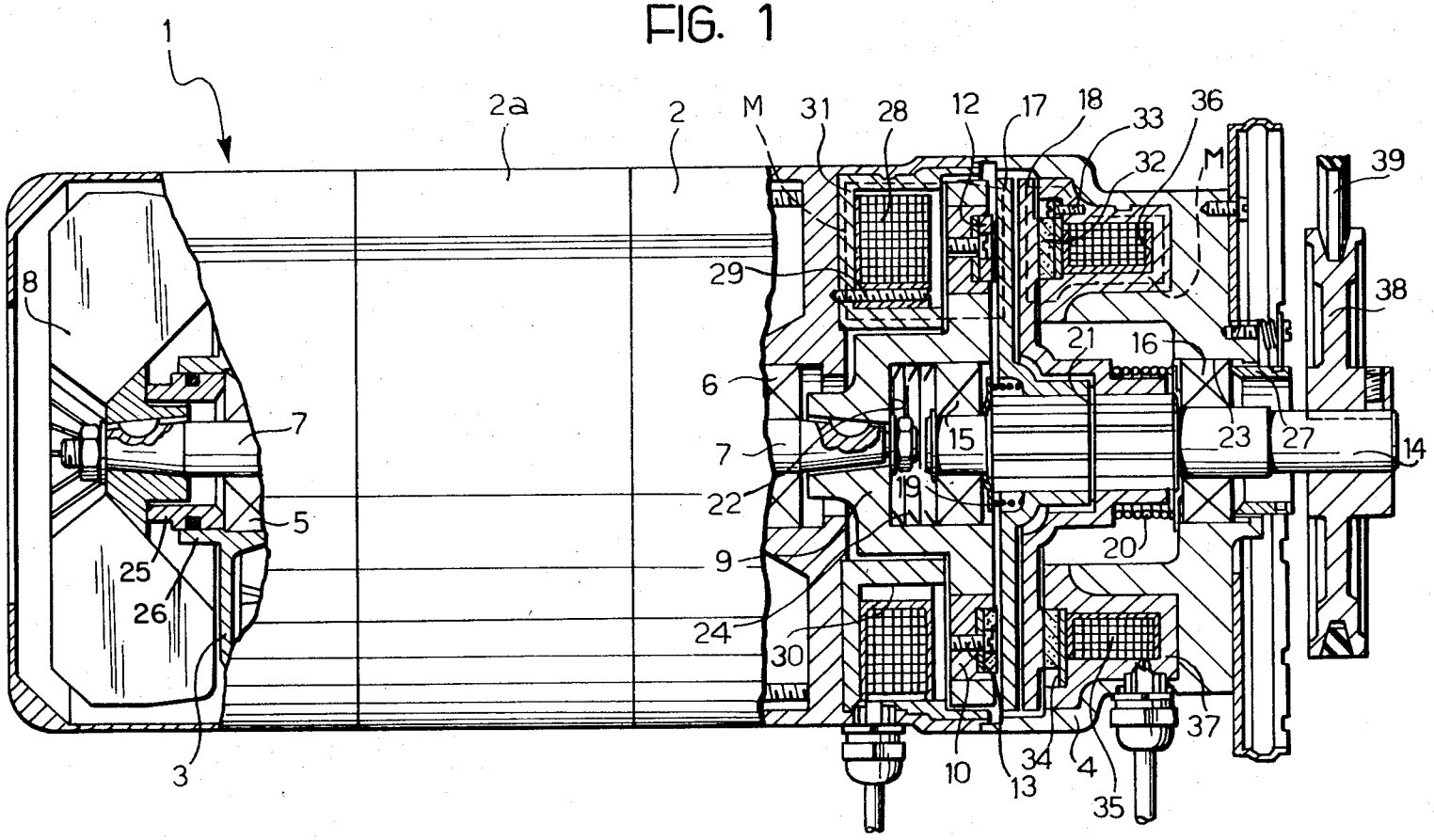
FIG. 1 is a longitudinal sectional view of a motor positioner unit according to the present invention.

FIG. 1 illustrates a motor positioner unit 1 for sewing machines, comprising a fixed structure including a substantially cylindrical casing 2 of non-ferromagnetic material (for example, aluminium) and two end covers 3, 4 also of non-ferromagnetic material.

The casing 2 includes the stator winding *2a* of the electric motor, within which the drive shaft 7 is rotatably mounted by means of ball bearings 5, 6.

A fan 8 for drawing cooling air into the casing 2 is fixed to one end of the shaft 7, while to the opposite end is fixed a flywheel 9 of ferromagnetic material which incorporates an intermediate ring 10 of non-ferromagnetic material.

Figure 3:
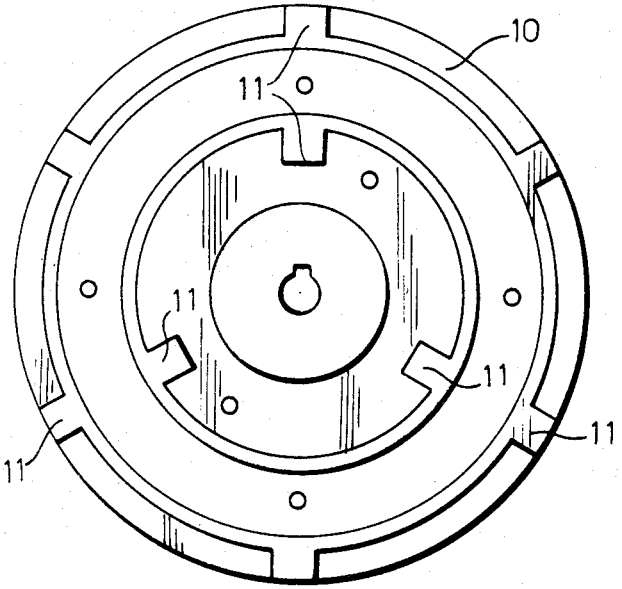
FIG. 3 is a front view of the detail of FIG. 2.
Figure 2:
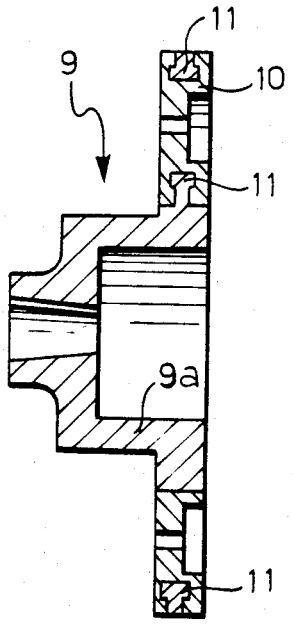
FIG. 2 illustrates a detail of FIG. 1.

FIGS. 2 and 3 illustrate the hub *9a* and the intermediate ring 10 forming part of the flywheel 9. The intermediate ring 10 is fixed to the hub *9a* and to the outer part of the flywheel 9 by means of an insertion coupling 11. The coupling of the ring 10 to the hub *9a* and to the peripheral part of the flywheel 9 is achieved by fusion.

With reference to FIG. 1, the intermediate non-ferromagnetic ring 10 is provided with an annular friction lining 12 which is fixed to the ring by screws 13.

The motor positioner unit 1 has an output shaft 14 rotatably mounted within the cover 4 by means of ball bearings 15, 16.

On the output shaft 14 are slidably mounted, by means of a grooved coupling, the hubs of two discs 17, 18 of ferromagnetic material, which constitute respectively the clutch disc and the brake disc of the brake-clutch unit with which the motor positioner unit is provided.

Between the hub of disc 18 and ball bearing 16 is located spring 20. Similarly, between the hub of disc 17 and ball bearing 15 is located spring 19. These springs 19, 20 bias the hubs against an intermediate stop ring 21 fixed to the output shaft 14.

The two bearings 15, 16 are mounted for possible axial sliding movement within two cylindrical cavities 22, 23 formed in the flywheel 9 and the cover 4, respectively. Between the ball bearing 15 and the end of the cavity 22 are located resilient corrugated springs 24 which urge the flywheel 9 and the bearing 15 away from each other. The bearings 5, 6 are also slidably mounted in their respective seats.

In particular, the springs 24 tend to bias the flywheel 9, together with the shaft 7 and ball bearing 5, towards an extreme position in which the bearing 5 is in contact with the frontal surface of a setting ring 25 screwed into a hub 26 forming part of the cover 3. At the same time, the springs 24 bias the ball bearing 15, together with the output shaft 14 carrying the discs 17, 18 and the ball bearing 16, towards an extreme position in which the bearing 16 is in contact with the frontal surface of a setting ring 27 screwed into the cover 4. The function of the rings 25, 27 will be explained below.

The intermediate ring 10 of the flywheel 9 is interposed between the clutch disc 17 and a clutch winding 28 which is mounted by screws 29 within a cavity 30 of an annular ferromagnetic insert 31 carried by the casing.

The brake disc 18 faces an annular friction lining 32 which is fixed by screws 33 to a ring 34 of non-ferromagnetic material.

The annular friction lining 32 is interposed between the brake disc 18 and a brake winding 35 mounted within a cavity 36 of a ferromagnetic insert 37 to which the ring 34 is fixed. The insert 37 is carried by the cover 4.

The end of the output shaft 14 which projects from the cover 4 has a pulley 38 for driving the sewing machine with which the unit 1 is associated through a belt 39.

When, during assembly of the unit, it is necessary to set the clearance between the disc 17 and the friction lining 12 and between the disc 18 and the friction lining 32, this is carried out as follows:

As long as the setting rings 25, 27 are not screwed into their respective seats, the springs 24 maintain the flywheel 9 against the frontal surface of the insert 31 which faces it, and the brake disc 18 against its friction lining 32.

By screwing the setting ring 25 into the hub 26, the ball bearing 5, together with the drive shaft 7 and the flywheel 9, are displaced towards the right (with reference to FIG. 1). Thus, the flywheel 9 is withdrawn from the frontal surface of the insert 31 so as to allow the flywheel to rotate freely without rubbing against the lining. Once this condition is achieved, the setting ring 27 is screwed to displace the bearing 16 and the output shaft 14, together with the discs 17, 18, towards the left (with reference to FIG. 1). As a result of this displacement, the brake disc 18 is moved away from its friction lining 32 so as to be free to rotate without rubbing against the lining.

The amount by which the rings 25, 27 are screwed can be adjusted to set the clearance between the clutch disc 17 and the friction ling 12, and between the brake disc 18 and the friction lining 32.

In the motor positioner unit according to the present invention, each of these clearances is, for example, about 0.7 mm.

The linings 25, 27 are easily accessible from outside so that the setting operation is extremely easy and quick. When, for example, after prolonged use, the linings 12, 32 are so worn that it is necessary to reduce the clearances, it suffices to screw in the ring 25 to bring the friction lining 12 closer to the clutch disc 17 and unscrew the ring 27 to bring the brake disc 18 closer to the friction lining 32.

In FIG. 1, the lines of magnetic flux generated by the energisation of the windings 28, 35 are indicated M.

By virtue of the particular arrangement described above, these lines follow a simple regular path thereby avoiding leakage of the magnetic flux. In particular, the fact that the fixed structure of the motor is of non-ferromagnetic material and the windings are mounted in ferromagnetic inserts allows leakage of the magnetic flux into the fixed structure of the motor to be avoided.

The main advantage resulting from the absence of leakage of the magnetic flux lies in the fact that a high attractive force can be developed with a lower usage of electrical power.

The fact that high attractive forces are developed gives various advantages:

(a) high torque is transmitted;

(b) the movement of the discs 17, 18 is very rapid, of the order of thousandths of a second, which results in a reduction in dead times;

(c) the air gap can be set approximately so that specialist workmen are not required to carry out this setting, and (d) friction linings with working parts of the order of 1.2–1.5 mm thick (compared with 0.2 mm for the known solutions) are used, which prolongs the useful life of the friction linings by six or seven times.

A further advantage of the motor positioner unit according to the present invention lies in the fact that the annular friction linings 12, 32 are fixed to the flywheel 9 and the fixed stop ring 34 respectively, instead of to the two discs 17, 18. Thus, in the unit according to the present invention, the linings come into contact with the ferromagnetic material (steel) constituting the discs 17, 18, which is obviously less prone to wear than non-ferromagnetic material, as opposed to the solutions of the prior art in which the friction linings come into contact with non-ferromagnetic material (aluminium) causing relatively rapid wear.

Finally, the friction linings 12, 32 are fixed to respective supports by screws which render the replacement of these linings particularly easy and rapid.

Figure 4:
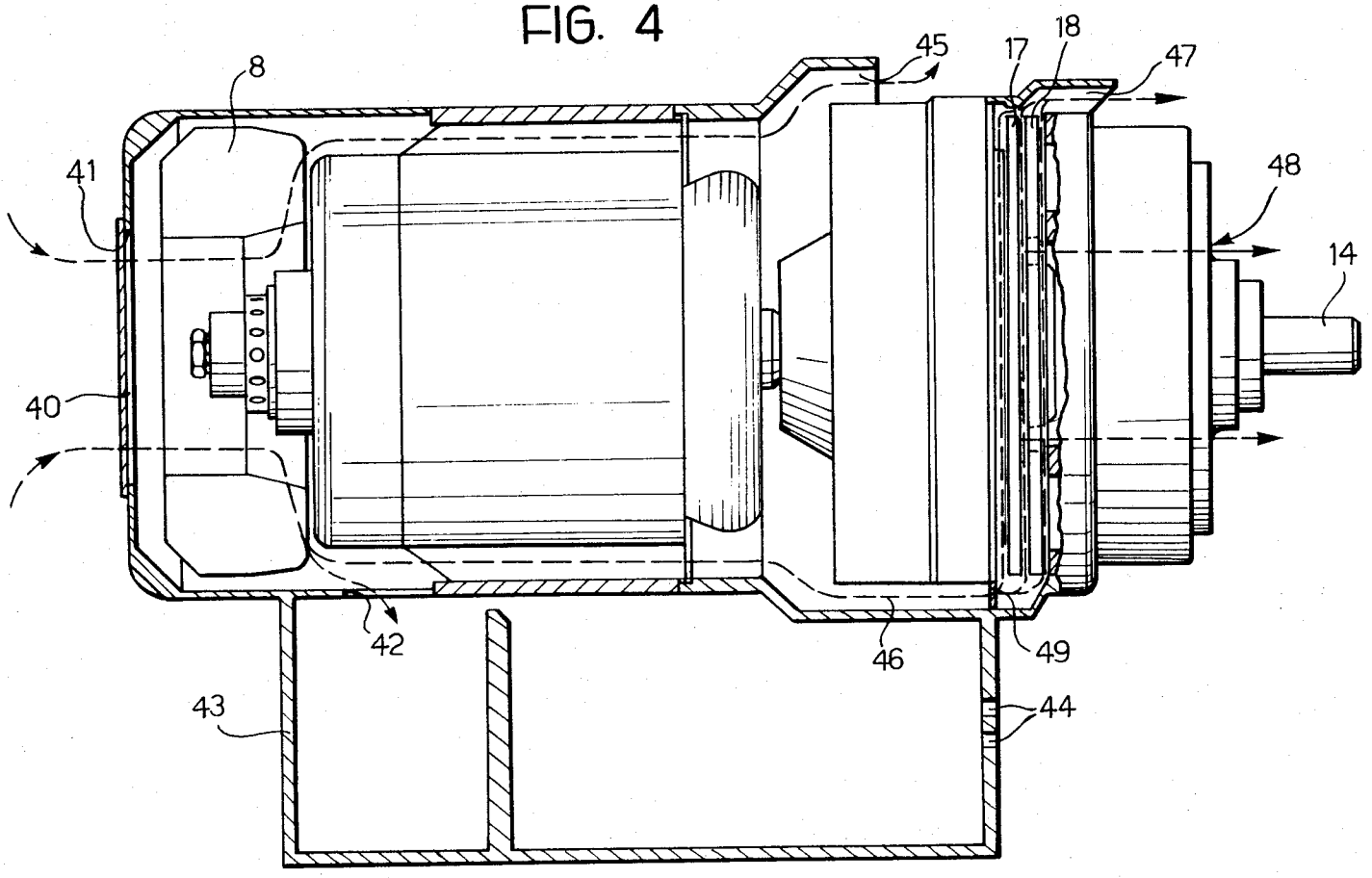
FIG. 4 illustrates the cooling system with which the unit of FIG. 1 is provided.

Again, in order to prolong the working life of the unit and render the replacement of the friction linings less frequent, the motor positioner unit is provided with an improved ventilation system which is illustrated in FIG. 4.

With reference to this Figure, the fan 8 is rotated by the drive shaft 7 and draws cooling air into the casing of the motor, forcing it through a filter 40 located at an inlet aperture 41.

Part of the cooling air is conveyed through an aperture 42 into a housing 43 containing the electronic controls of the motor positioner unit.

The air which enters the housing 43 leaves through the slots 44 shown schematically in FIG. 4.

The remainder of the air passes through the space between the outer casing and the stator casing of the motor, and part of its passes to the exterior through an aperture 45.

That part of the air which does not leave is conveyed through a passage 46 into the zone of the brake and clutch discs, and is forced to flow through the zone between these discs and the zones between the discs and their friction linings. Part of this air flow leaves through an aperture 47, while the remainder leaves through a front aperture 48 after flowing over the output shaft 14.

A further filter 49 is located in the passage 46 for collecting impurities which might have avoided the filter 40, so as to prevent damage to the surfaces of contact between the clutch and brake discs and their friction linings.

The operation of the motor positioner unit described above is as follows.

Assuming that the drive shaft 7 is rotating and the clutch and brake windings 28, 35 are not energized, the drive shaft 7 rotates the flywheel 9 but this rotation is not transmitted to the output shaft 14 which, under these conditions, is stationary. The load offered by the sewing machine, which is connected to the output shaft 14 through the transmission belt 39 and the pulley 38, suffices to cancel any entrainment caused by friction due to the rotation of the ball bearing 15.

In order to rotate the output shaft 14 which drives the sewing machine, it is necessary to supply the clutch winding 28 with current. Following the energisation of this winding, the clutch disc 17 moves axially on the shaft 14 until it comes into contact with the annular friction lining 12 so as to be rotated by friction through the lining from the flywheel 9.

The attractive force produced by the winding 28 is clearly sufficient to overcome the force of the spring 19.

This attractive force is also dependant on the current supplied to the winding 28. A variation of the current consequently varies the torque transmitted by the clutch disc 17 and the rate of rotation of the output shaft 14.

When it is necessary to slow or stop the machine, the winding 28 is de-energised and the brake winding 35 is energised. The magnetic flux generated by this winding develops an attractive force which causes an axial displacement of the brake disc 18 towards the friction lining 32 against the action of the spring 20. In this case also, the attractive force developed by the winding 35 clearly suffices to overcome the action of the spring 20. As a result of the contact between the brake disc 18 and the annular friction lining 32 carried by the fixed stop ring 34, the output shaft 14 is slowed and, if necessary, stopped.

Naturally, the effects of the present model also extend to other inventions which achieve equal utility by using the same innovative concept.

What is claimed is:

1. A motor unit for sewing machines, comprising:
- a fixed structure of non-ferromagnetic material;
- a motor mounted within said fixed structure;
- a stop ring of non-ferromagnetic material;
- a drive shaft driven by the motor;
- a flywheel of ferromagnetic material connected to the drive shaft, said stop ring being of non-ferromagnetic material and being fixed to said flywheel;
- an output shaft, and
- an electromagnetically operated brake-clutch unit for controlling a connection between the drive shaft and the output shaft, said brake-clutch unit including:
- a clutch disc and a brake disc both of ferromagnetic material, said clutch disc and said brake disc being slidable axially on the output shaft and connected for rotation therewith, the clutch disc and the brake disc facing said flywheel and said fixed stop ring, respectively, a clutch winding and a brake winding carried by the fixed structure, the flywheel being interposed between the clutch winding and the clutch disc, and the fixed stop ring being interposed between the brake winding and the brake disc, ferromagnetic inserts mounted on said fixed structure, said ferromagnetic inserts defining annular cavities, the clutch winding and the brake winding being mounted in said annular cavities respectively on said ferromagnetic inserts carried by the fixed structure, and two annular friction linings for a frictional connection of the clutch disc and the brake disc with the flywheel and the fixed stop ring.

2. A motor unit as defined in claim 1, wherein the two annular friction linings are fixed to the non-ferromagnetic ring incorporated in the flywheel and to the fixed stop ring, respectively.

3. A motor unit as defined in claim 2, wherein the friction linings are fixed to said rings by screws.

4. A motor unit as defined in claim 1, including a casing for the unit, wherein the drive shaft is provided with a fan for drawing cooling air into said casing, and said casing defines passages for conveying at least some of the cooling air between the brake and clutch discs and between said discs and their respective friction linings.

5. A motor unit as defined in claim 1, wherein resilient means are provided to bias the drive shaft and the output shaft away from each other, and a setting ring is associated with each shaft to push the respective shaft towards the other shaft against the action of said resilient means.

* * * * *